United States Patent [19]

Vecchiarelli

[11] 4,245,687

[45] Jan. 20, 1981

[54] VENETIAN BLIND AND TILTING MECHANISM THEREFOR

[75] Inventor: Francis Vecchiarelli, River Edge, N.J.

[73] Assignee: Hunter Douglas International N.V., Netherlands Antilles

[21] Appl. No.: 43,802

[22] Filed: May 30, 1979

[51] Int. Cl.[3] ..... E06B 9/38

[52] U.S. Cl. ..... 160/177

[58] Field of Search ..... 160/166–178 R

[56] References Cited

U.S. PATENT DOCUMENTS

| | | | |
|---|---|---|---|
| 2,498,079 | 2/1950 | Hunter | 160/177 |
| 2,602,503 | 7/1952 | Machroll | 160/173 |
| 2,809,531 | 10/1957 | Moyer | 160/177 |
| 4,141,402 | 2/1979 | Marotto | 160/176 R |

*Primary Examiner*—Peter M. Caun

*Attorney, Agent, or Firm*—Pennie & Edmonds

[57] ABSTRACT

A venetian blind and a tilting mechanism for fitting in a venetian blind headrail for tilting the slats of a venetian blind, in which a rotary drive shaft having a worm drivingly engages a rotary wormwheel, these parts being enclosed in a housing which is formed as a one-piece stamping of two identical mirror image parts which are hinged with a solid hinge to one another, and are provided with bearing parts on each portion which together form a rotary bearing for the drive shaft and worm and rotary bearing for the wormwheel, the mounting bracket serving to hold the two housing portions together in the closed position of the hinge and retain the mechanism as a single assembly.

8 Claims, 2 Drawing Figures

VENETIAN BLIND AND TILTING MECHANISM THEREFOR

DESCRIPTION

BACKGROUND OF THE INVENTION

The present invention relates to a tilting mechanism for fitting in a venetian blind headrail for tilting the slats of the venetian blind.

Such tilting mechanisms have been known for many years and usually comprise a drive shaft provided with a worm which is engageable with a wormwheel, which usually has a central non-circular cross-section aperture therein for the passage of the tilting rod, which connects the tilting mechanism to two or more ladder means tilting rolls positioned within the venetian blind headrail. With some of these tilting mechanisms the worm is operated by means of a long shaft or "wand". The headrail itself usually consists of a channel section member having a lower web and front and rear flanges, each provided at their top edges with inturned rims.

The known tilting mechanisms are relatively complex in their structure and their assembly is difficult. Additionally, the method of fixing is difficult and time consuming as the mechanism has to be mounted securely to withstand operating forces.

SUMMARY OF THE INVENTION

It is now proposed, according to the present invention, to provide a tilting mechanism for fitting in a venetian blind headrail for tilting the slats of the venetian blind, said tilting mechanism comprising, in combination:

(a) a rotary drive shaft;
(b) a worm mounted on said drive shaft;
(c) a rotary wormwheel drivably engaged by said worm;
(d) a one-piece housing including two mirror-image housing portions;
(e) a solid hinge hingedly connecting said two portions to one another so that they may be moved between an open position and a closed position;
(f) two bearing parts on each portion together forming a rotary bearing for said drive shaft and worm and a rotary bearing for said wormwheel, when said housing portion is hinged to its closed position;
(g) means to lock said housing portions in said closed position.

Such a structure can be made relatively cheaply, since the one-piece housing and solid hinge can be formed by stamping or as a moulding. The member can be made relatively weak at the point where the two parts meet, so that hinging of two parts relative to one another is simple. It will be appreciated that the assembly operation is extremely easy with such a construction, it merely being necessary to place the worm and wormwheel on one housing portion and fold the other housing portion over, and thereafter to fit a locking arrangement to hold the two portions in the closed position.

This folding operation is particularly facilitated if the housing portions are hinged to one another at a location adjacent the drive shaft about a hinge line which is in a plane which includes the axis of rotation of the drive shaft and which is perpendicular to the axis of the wormwheel.

The locking means are advantageously in the form of a mounting bracket for holding the mechanism in the venetian blind headrail, for example an L-shaped bracket having a base adapted to lie on the lower web of the headrail and an upstanding wall which is engageable with the housing portions.

A better bearing for the drive shaft can be achieved if the base of the L-shaped bracket has an aperture which serves as a bearing to receive for rotation the drive shaft. The wall of the bracket may be provided with wings, between which are engaged the ends of the housing portions which are remote from the hinge line. Tongues on the ends of the housing parts may then be engaged in apertures on the side wall. A sturdy construction is thus obtained.

In order more easily and still firmly to secure the mechanism in the headrail a hook is advantageously provided on the housing at a point adjacent the hinge and is engageable with the inturned rim on the upper edge of one flange of the venetian blind headrail, whilst a latch at the upper part of the wall can engage with the inturned rim at the upper edge of the other flange of the venetian blind headrail.

In order that the present invention may more readily be understood, the following description is given, merely by way of example, of the presently considered best mode of putting the invention into effect, reference being made to the accompanying drawings.

DETAILED DESCRIPTION OF THE PREFERRED EMBODIMENT

Figure 1:
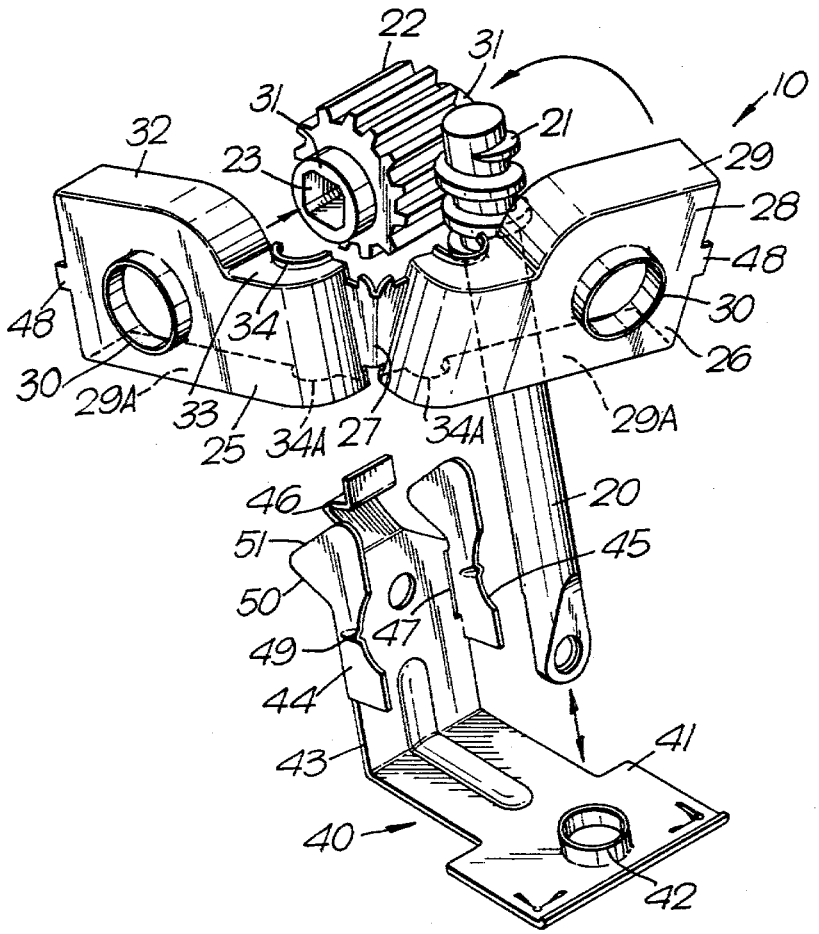
FIG. 1 is a perspective exploded view showing the assembly of the parts of one embodiment of tilting mechanism according to the invention.
Figure 2:
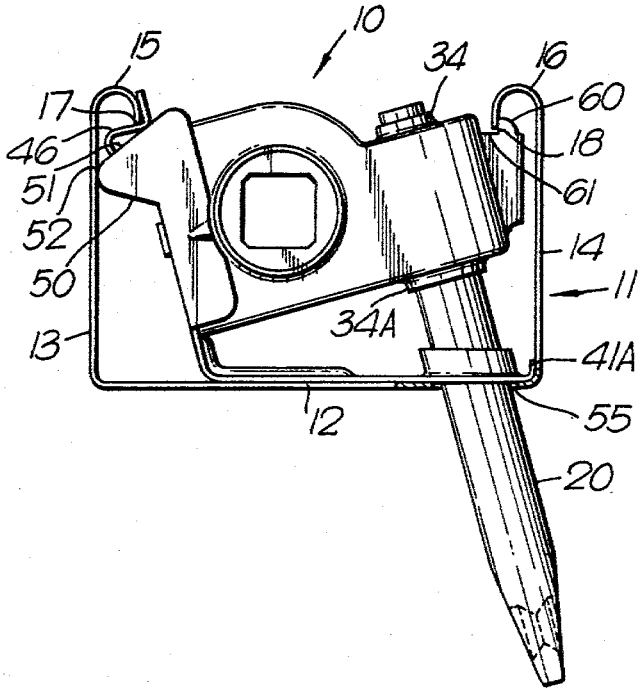
FIG. 2 is a side elevation of the mechanism of FIG. 1 indicated in a venetian blind headrail.

A tilting mechanism 10, which is shown in the exploded condition in FIG. 1, is illustrated in FIG. 2 mounted in a headrail 11. This headrail is of channel shape cross-section having a lower web 12, and rear and front flanges 13 and 14, having, at their upper edges, inturned rims 15 and 16 each having a tip 17, 18 respectively.

Referring to FIG. 1, it will be seen that the tilting mechanism includes a drive shaft 20 having a worm 21 at its upper end, this being engageable with a wormwheel 22, which is of conventional design having a substantially square cross-section aperture 23 for the insertion of the tilting rod (not shown) for causing a tilting movement of a tilting roll, which in turn carries the ladder cords of the venetian blind.

The housing of the mechanism is formed as a single member e.g. as a plastic moulding, or an aluminium stamping, and includes two substantially identical mirror image portions 25 and 26, which are joined together by a solid hinge 27, which in fact is part of the single member. Each part 25, 26, includes a side wall 28, a top wall 29 and a bottom wall 29A. The side walls 28 are each provided with a bearing aperture 30 dimensioned to accommodate shaft portions 31 on the wormwheel 22. The top walls include a portion 32 which is sufficiently large to accommodate the wormwheel 22, and a reduced height portion 33 which has a semi-circular recess 34 which together, when the two portions 25, 26 are hinged to their closed position, form an upper circular bearing for the top end of the shaft 20 above the worm 21. Similarly the bottom walls 29A include semi-circular recesses 34A which form, in the closed position, a lower circular bearing for the shaft 20 immediately below the worm 21. The lower circular bearing acts as an axial thrust bearing which also prevents the worm and shaft from dropping out of the housing.

The tilting mechanism also includes a mounting bracket indicated by the general reference numeral 40 in FIG. 1, this having a base 41 with an aperture 42 of a diameter to accommodate the lower end of the shaft 20 and form a bearing therefor. The base 41 is bent up at 41A to engage in the angle between the web 12 at front flange 14.

An upstanding wall 43 is provided at the other end of the base and has two wings 44, 45, one at each side. At its upper end the wall 43 is provided with a latch arrangement 46. Located just inwardly of the wings 45 are elongate apertures or slots 47 which are sized to accommodate tongues 48 which are formed on each side wall 28 of the hinge portions 25, 26. It will be observed that the wings have a curved recessed portion 49 to accommodate the rim of the apertures 30, and also that the wings are provided with inclined surfaces 50, 51 at their lower and upper portions.

In order to assemble the mechanism illustrated in FIG. 1, the worm and shaft 20 are accommodated in one of the semi-circular recesses 34 and the shaft portions 31 of the wormwheel 22 is accommodated in the aperture 30 of the same portion, and the other portion is then pivoted around about the hinge line of solid hinge 27 so that the aperture 30 thereof engages the other shaft portion 31 of the wormwheel 22, and the other semi-circular recess 34 engages fully around the remainder of the shaft 20. With the parts held together in this way, the assembly is offered up to the bracket 42 with the shaft 20 being lowered through the aperture 42. Downward movement of the previously formed subassembly enables the housing portions 25, 26 to be introduced between the wings 50 and finally for the tongues 48 to engage in the slots 47, the tongues being bent thereafter for fixing. By this time the pushout portions surrounding the apertures 30 engage in the semi-circular recesses 49 in the wings.

The whole assembly is then introduced into the headrail, as shown in FIG. 2, with the shaft 20 being passed through an aperture 55 in the lower web 12 of the headrail. As the downward movement occurs, the curved upper surface 60 of the housing portion adjacent the hinge pivots the inturned rim 16 outwardly and eventually the edge 18 snaps back over the hook 61 formed adjacent the hinge by the lefthand edge of the curved portion 60.

At the same time, the inclined surface 50 causes flexing out of the inturned rim 15, and this rim thereafter rides over the nose portion 52 between the surfaces 50 and 51, slides down the surface 51. Eventually the edge 17 of the rim 15 engages over the resilient latch 46 and the whole assembly is thus locked in place in the headrail. The resilience of the latch 46 compensates for any dimensional variation of the headrail and the tilting mechanism. When it is desired to remove the mechanism, the rim 16 is sprung off the hook 61 and the latch is bent inwardly and then the mechanism is raised. The inclined upper surface 51 bears against tip 17 and flexes the rear wall rearwardly, while the curved portion 61 bears on the tip 16 and flexes the front wall forwardly.

This is a particularly simple structure both from a mechanical parts point of view and from ease of assembly both of the mechanism to itself and of the mechanism into the headrail.

I claim:

1. A tilting mechanism for fitting in a venetian blind headrail for tilting the slats of the venetian blind, said tilting mechanism comprising, in combination:

(a) a rotary drive shaft;
(b) a worm mounted on said drive shaft;
(c) a rotary wormwheel drivably engaged by said worm;
(d) a one-piece housing including two mirror-image housing portions;
(e) a solid hinge, hingedly connecting said two portions to one another so that they may be moved between an open position and a closed position;
(f) two bearing parts on each portion together forming a rotary bearing for said drive shaft and worm and a rotary bearing for said wormwheel, when said housing portion is hinged to its closed position;
(g) means to lock said housing portions in said closed position.

2. A tilting mechanism according to claim 1, wherein each housing portion has an upper and a lower bearing part for the drive shaft and worm.

3. A tilting mechanism according to claim 1 or 2, wherein said two housing portions are hinged to one another at a location adjacent said drive shaft about a hinge line in a plane which includes the axis of rotation of the drive shaft and which is perpendicular to the axis of the wormwheel.

4. A tilting mechanism according to any preceding claim, wherein said means to lock said housing portions in said closed positions include a mounting bracket for mounting said mechanism in a venetian blind headrail, said mounting bracket being generally L-shaped, having a base adapted to lie on the lower web over the venetian blind headrail and a wall upstanding from said base engageable with said housing portions.

5. A tilting mechanism according to claim 4, wherein said base further comprises a bearing to receive for rotation therein said drive shaft.

6. A tilting mechanism according to claim 4 or 5, wherein said wall comprises side wings, between which are engaged the ends of said housing portions remote from the hinge line between said portions, and further comprising tongues on said ends of said housing portions engaged in apertures on said wall.

7. A tilting mechanism according to claim 4, 5 or 6, and further comprising a hook on said housing adjacent the hinge engageable with the inturned rim on the upper edge of one flange of a venetian blind headrail and a resilient latch at the upper part of the wall engageable with the inturned rim at the upper edge of the other flange of the venetian blind headrail, to hold the mechanism in place in said headrail.

8. A venetian blind comprising a headrail, which is of channel-shaped cross-section, formed of a lower web and front and rear flanges and having an inturned rim at the upper free edges of the front and rear flanges, a tilt mechanism carrying a tilt rail extending longitudinally of the headrail, said tilt mechanism comprising in combination:

(a) a rotary drive shaft;
(b) a worm mounted on said drive shaft;
(c) a rotary wormwheel drivably engaged by said worm;
(d) a one-piece housing including two mirror-image housing portions;

(e) a solid hinge, hingedly connecting said two portions to one another so that they may be moved between an open position and a closed position;

(f) two bearing parts on each portion together forming a rotary bearing for said drive shaft and worm and a rotary bearing for said wormwheel, when said housing portion is hinged to its closed position;

(g) means to lock said housing portions in said closed position.

* * * * *